US008254603B2

(12) United States Patent
Suzuki et al.

(10) Patent No.: US 8,254,603 B2
(45) Date of Patent: Aug. 28, 2012

(54) SPEAKER APPARATUS AND METHOD FOR DRIVING SPEAKER

(75) Inventors: Nobukazu Suzuki, Kanagawa (JP); Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 714 days.

(21) Appl. No.: 12/275,329

(22) Filed: Nov. 21, 2008

(65) Prior Publication Data

US 2009/0136077 A1 May 28, 2009

(30) Foreign Application Priority Data

Nov. 26, 2007 (JP) ..... 2007-304010

(51) Int. Cl.
*H04R 25/00* (2006.01)
*H04R 5/02* (2006.01)
*H04R 1/20* (2006.01)
*H04R 1/00* (2006.01)

(52) U.S. Cl. ..... 381/191; 381/152; 381/190; 381/300; 381/337; 381/396; 381/431

(58) Field of Classification Search ..... 381/152, 381/190, 300, 337, 396, 431, 191
See application file for complete search history.

(56) References Cited

U.S. PATENT DOCUMENTS

| | | | | |
|---|---|---|---|---|
| 4,903,308 | A * | 2/1990 | Paddock et al. | 381/430 |
| 5,770,133 | A * | 6/1998 | Boutaghou | 264/135 |
| 6,198,831 | B1 * | 3/2001 | Azima et al. | 381/338 |
| 6,295,365 | B1 * | 9/2001 | Ota | 381/114 |
| 6,349,141 | B1 * | 2/2002 | Corsaro | 381/190 |
| 6,359,371 | B1 * | 3/2002 | Perkins et al. | 310/328 |
| 6,546,106 | B2 * | 4/2003 | Azima | 381/152 |
| 6,749,666 | B2 * | 6/2004 | Meegan, Jr. | 95/29 |
| 6,819,769 | B1 * | 11/2004 | Zimmermann | 381/152 |
| 6,836,552 | B1 * | 12/2004 | Bachmann et al. | 381/431 |
| 7,106,881 | B2 * | 9/2006 | Backman | 381/408 |
| 7,269,306 | B1 * | 9/2007 | Koeneman et al. | 385/7 |
| 7,382,079 | B2 * | 6/2008 | Kawase et al. | 310/322 |
| 7,400,080 | B2 * | 7/2008 | Benslimand et al. | 310/369 |
| 2001/0033669 | A1 * | 10/2001 | Bank et al. | 381/152 |
| 2003/0099371 | A1 * | 5/2003 | Ogura et al. | 381/426 |
| 2005/0116798 | A1 * | 6/2005 | Bintoro et al. | 335/78 |
| 2006/0050904 | A1 | 3/2006 | Metheringham et al. | |
| 2006/0147051 | A1 * | 7/2006 | Smith et al. | 381/71.2 |
| 2009/0103767 | A1 * | 4/2009 | Kuroda et al. | 381/388 |
| 2009/0115004 | A1 * | 5/2009 | Carter et al. | 257/414 |
| 2009/0129613 | A1 * | 5/2009 | Burton et al. | 381/190 |

FOREIGN PATENT DOCUMENTS

| | | | |
|---|---|---|---|
| JP | 2001-328065 | A | 11/2001 |
| JP | 2005-204200 | A | 7/2005 |
| JP | 2006-511135 | A | 3/2006 |
| JP | 2006-238575 | A | 9/2006 |
| JP | 2007-166027 | A | 6/2007 |
| JP | 2007-214917 | A | 8/2007 |
| JP | 2007-228557 | A | 9/2007 |
| JP | 2008-177980 | A | 7/2008 |

* cited by examiner

*Primary Examiner* — Ida M. Soward
(74) *Attorney, Agent, or Firm* — Wolf, Greenfield & Sacks, P.C.

(57) ABSTRACT

A speaker apparatus includes an acoustic vibration plate, and an actuator mounted to the acoustic vibration plate such that one end and the other end thereof, in a driving axis direction, exist in a plate surface of the acoustic vibration plate. The actuator applies vibration to the acoustic vibration plate to play back sound. The speaker apparatus enables a sound image to uniformly spread over the entire plate surface of the acoustic vibration plate. In addition, the entire speaker apparatus can be made compact.

20 Claims, 18 Drawing Sheets

SPEAKER APPARATUS AND METHOD FOR DRIVING SPEAKER

CROSS REFERENCES TO RELATED APPLICATIONS

The present invention contains subject matter related to Japanese Patent Application JP 2007-304010 filed in the Japanese Patent Office on Nov. 26, 2007, the entire contents of which are incorporated herein by reference.

BACKGROUND OF THE INVENTION

1. Field of the Invention

The present invention relates to a speaker apparatus for playing back sound by applying vibration to an acoustic vibration plate by an actuator, such as a magnetostrictive actuator, and a method for driving the speaker apparatus.

2. Description of the Related Art

A speaker apparatus for playing back sound by applying vibration to an acoustic vibration plate by an actuator, such as a magnetostrictive actuator, has been developed.

As shown in FIG. 18, in one of the speaker apparatuses of such type, a driving rod 95 of a magnetostrictive actuator 90 is contacted to a plate-shaped acoustic vibration plate 81 to apply vibration to the acoustic vibration plate 81 in thickness direction thereof, that is, a direction perpendicular to a plate surface.

In another one of the speaker apparatuses of such type, as disclosed in Japanese Unexamined Patent Application Publication No. 2007-166027 and shown in FIG. 19, for example, a cylindrical acoustic vibration plate 85 with both ends open is supported vertically, and a plurality of magnetostrictive actuators 90 are disposed on the lower end side of the acoustic vibration plate 85 such that the driving rods 95 of the magnetostrictive actuators 90 are contacted to a lower end surface 86 of the acoustic vibration plate 85 to apply vibration to the acoustic vibration plate 85 in a direction perpendicular to the lower end surface 86, i.e., the plate surface direction.

In a speaker apparatus of the type shown in FIG. 19, although the lower end surface 86 of the acoustic vibration plate 85 is excited by a longitudinal wave, propagation of a vibration elastic wave in the plate surface direction of the acoustic vibration plate 85 mixes the longitudinal wave and a transverse wave, whereby a sound wave is radiated in directions perpendicular to the plate surface of the acoustic vibration plate 85 by the transverse wave. Thus, a spatial sound field is obtained.

A magnetostrictive actuator is an actuator using a magnetostrictive element which is deformable upon application of an external magnetic field. The amount of deformation of some magnetostrictive elements these days are nearly 1000 times the typical magnetostrictive elements (super-magnetostrictive elements), and magnetostrictive elements produces large stress when they are deformed. Thus, even a small magnetostrictive actuator can sound an acoustic vibration plate at relatively large sound volume, and it can sound even a hard acoustic vibration plate, such as an iron plate.

In addition, magnetostrictive actuators have excellent response speed. The response speed of a solitary magnetostrictive element is on the order of nanosecond.

SUMMARY OF THE INVENTION

However, in the speaker apparatus shown in FIG. 18, in which vibration is applied to the plate-shaped acoustic vibration plate 81 in directions perpendicular to the plate surface, the amplitude of vibration is largest at a vibration-application point (a point at which vibration is applied) Pa of the acoustic vibration plate 81, and the amplitude of vibration is small at a point distant from the vibration-application point Pa. This produces directivity in playback of sound, whereby the sound image does not spread.

Moreover, in the related art speaker apparatus shown in FIG. 18, if the length of the magnetostrictive actuator 90 (the length of the magnetostrictive element) is increased to increase the amplitude of vibration caused by the magnetostrictive actuator 90, the size (thickness) of the entire speaker apparatus increases in the thickness direction of the acoustic vibration plate 81. Thus, it is difficult to make a compact speaker apparatus.

On the other hand, in the speaker apparatus shown in FIG. 19, in which vibration is applied in the direction perpendicular to an end surface of the acoustic vibration plate 85, that is, in the plate surface direction of the acoustic vibration plate 85, as mentioned above, a sound image uniformly spreads over the entire plate surface of the acoustic vibration plate 85 and the sound image is uniformly localized over the entire acoustic vibration plate 85.

However, in the related art speaker apparatus shown in FIG. 19, it is necessary to provide a supporting member having holes for receiving the magnetostrictive actuators 90, the diameter of the supporting member being larger than that of the acoustic vibration plate 85 and the height (thickness) thereof in the central axis direction of the acoustic vibration plate 85 being large, and it is necessary that the magnetostrictive actuators 90 be received in the holes. Accordingly, compared to the size of the acoustic vibration plate 85, the entire speaker apparatus becomes considerably large.

The present invention is configured to allow the sound image to uniformly spread over the entire plate surface of the acoustic vibration plate and the size of the entire speaker apparatus to be reduced.

A speaker apparatus according to an embodiment of the present invention includes an acoustic vibration plate, and an actuator attached to the acoustic vibration plate such that one end and the other end thereof, in a driving axis direction, exist in a plate surface of the acoustic vibration plate.

In the speaker apparatus according to an embodiment of the present invention, having the above-described structure, because one end and the other end in the driving axis direction of the actuator exist in the plate surface of the acoustic vibration plate, vibration is applied to a point in the plate surface of the acoustic vibration plate and the longitudinal wave propagates from the vibration-application point to an outer end surface (terminal end surface) of the acoustic vibration plate. Thus, a sound image uniformly spreads over the entire plate surface of the acoustic vibration plate.

In addition, because the actuator exists in the plate surface of the acoustic vibration plate, the entire speaker apparatus does not become larger than the acoustic vibration plate. Accordingly, the speaker apparatus can be made compact, about the same size as the acoustic vibration plate.

DESCRIPTION OF THE PREFERRED EMBODIMENTS

1. First Embodiment

FIGS. 1 to 8

A first embodiment shows the case in which a magnetostrictive actuator is attached to a plate-shaped acoustic vibration plate and in which a driving axis direction of the magnetostrictive actuator forms a right angle with respect to a direction in which an outer end surface of the acoustic vibration plate is extended, to which longitudinal-wave vibration propagates.

Figure 2:
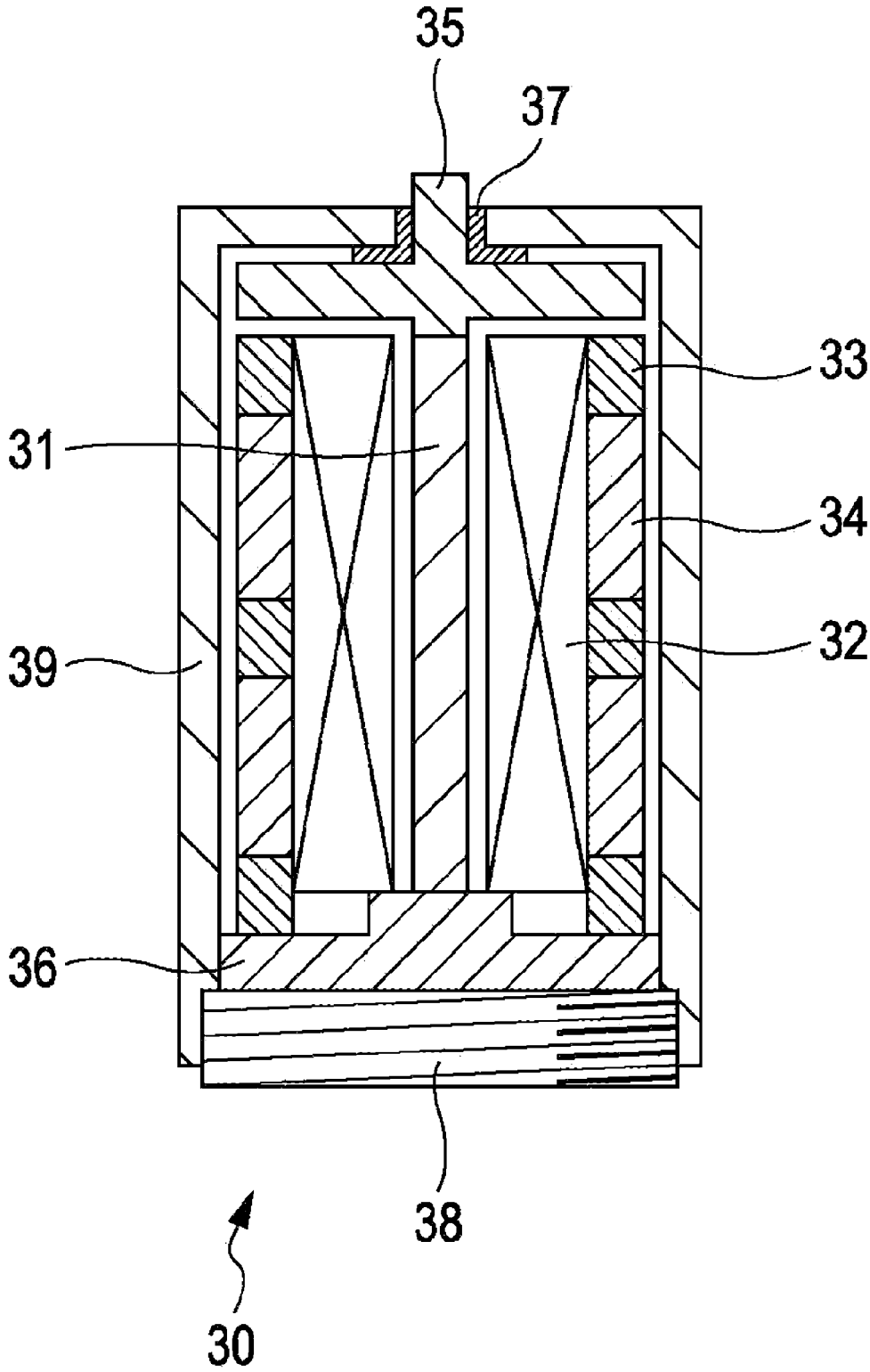
FIG. 2 shows an example of a magnetostrictive actuator.
Figure 3:
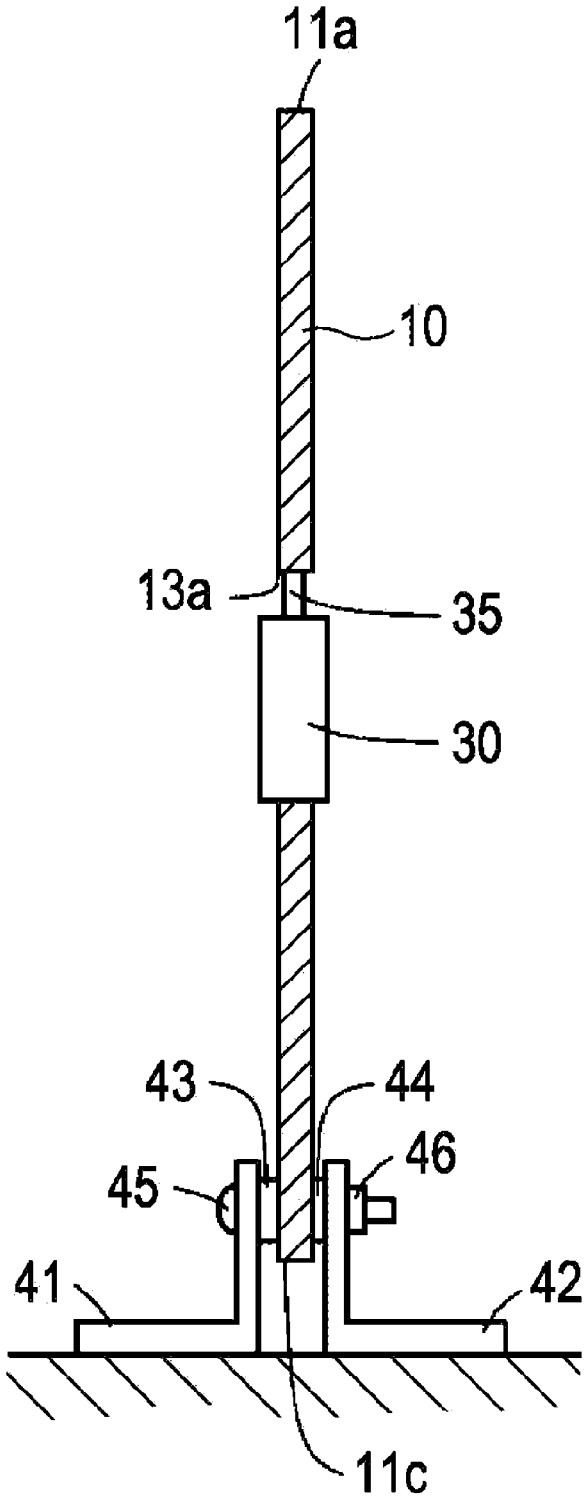
FIG. 3 shows an example of a support structure of the speaker apparatus.

1-1. First Example of First Embodiment: FIGS. 1 to 3

Figure 1A:
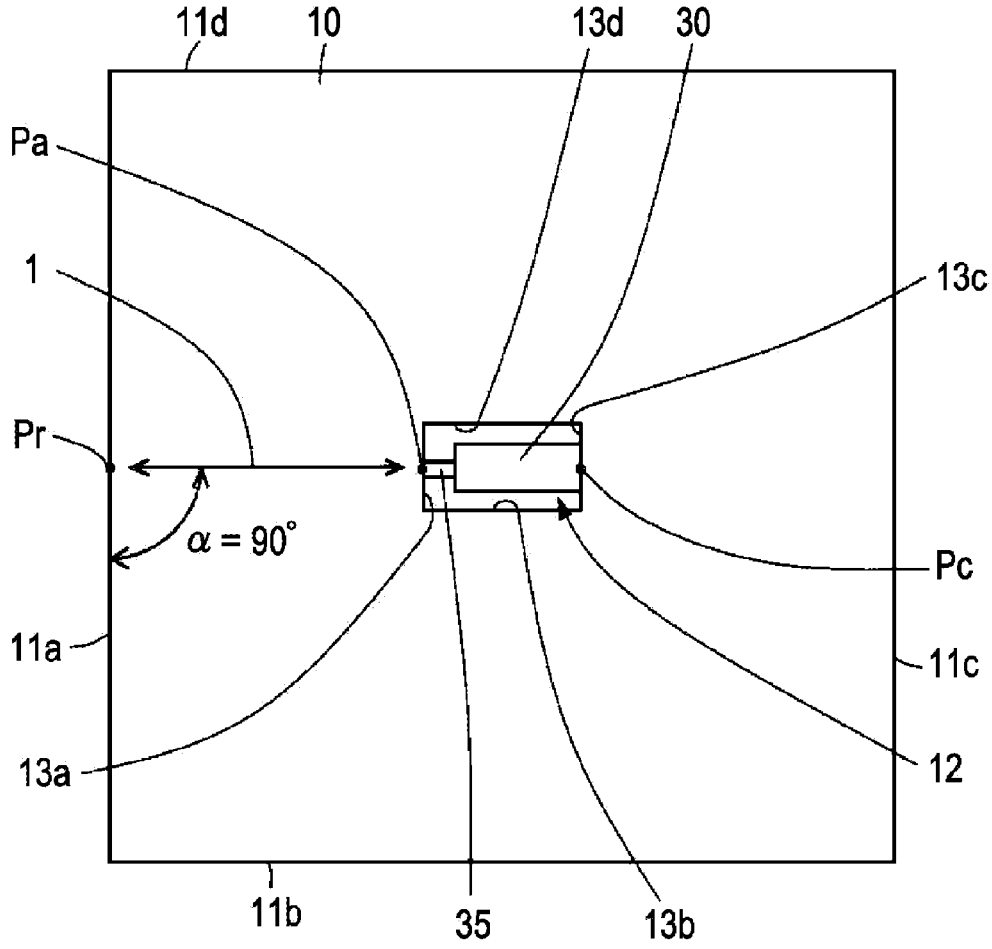
FIGS. 1A and 1B show a first example of a speaker apparatus according to a first embodiment of the present invention.
Figure 1B:
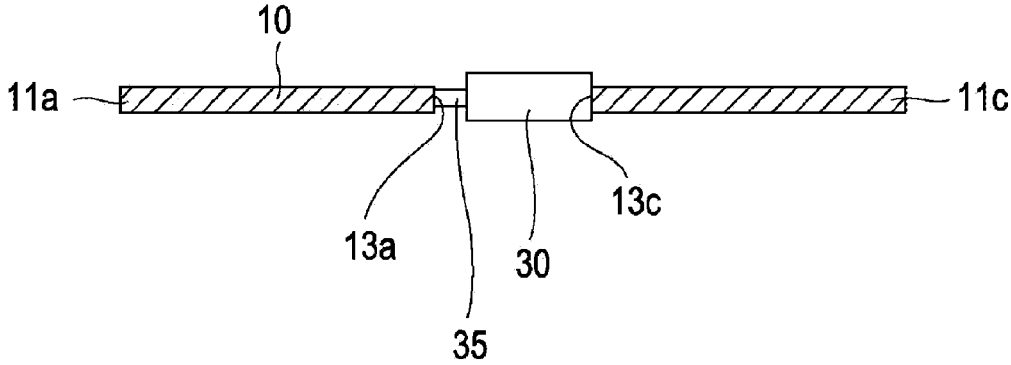

FIGS. 1A and 1B show a first example of a speaker apparatus according to a first embodiment of the present invention. FIG. 1A is a plan view, and FIG. 1B is a side sectional view of an acoustic vibration plate.

An acoustic vibration plate 10 is square plate-shaped, whose edge length is 290 mm and whose thickness is 3 mm, for example, is made of acrylic, and is provided with a rectangular hole 12 in the central portion thereof.

In this example, inner end surfaces 13*a*, 13*b*, 13*c*, and 13*d* of the acoustic vibration plate 10, facing the rectangular hole 12, are parallel to outer end surfaces 11*a*, 11*b*, 11*c*, and 11*d* of the acoustic vibration plate 10, respectively.

The magnetostrictive actuator 30 is mounted (fitted) in the rectangular hole 12 such that a tip of a driving rod 35 at one end of the magnetostrictive actuator 30 is contacted to the inner end surface 13*a* and a base portion at the other end is contacted to the inner end surface 13*c*. The base portion at the other end may be bonded to the inner end surface 13*c* by an adhesive, a double-faced adhesive tape, etc.

As shown in FIG. 2, the magnetostrictive actuator 30 is, for example, formed such that an actuator body, formed of a stick-shaped magnetostrictive element 31 surrounded by a solenoid coil 32 for applying a controlling electric field to the magnetostrictive element 31, magnets 33 and yokes 34 surrounding the solenoid coil 32, the driving rod 35 connected to one end of the magnetostrictive element 31, a fixed plate 36 attached to the other end of the magnetostrictive element 31, is fitted in an outer case 39 such that the tip portion of the driving rod 35 projects outward from the outer case 39.

Further, in this example, a damping material 37 made of silicon rubber or the like is fitted to the driving rod 35 and a screw 38 is inserted behind the fixed plate 36, so that a predetermined preload is applied to the magnetostrictive element 31. This makes it possible to expand and contract the magnetostrictive element 31 in accordance with a controlling current supplied to the solenoid coil 32, on the basis of a state in which the magnetostrictive element 31 has a predetermined length.

If the magnetostrictive element 31 is a super-magnetostrictive element, the magnetostrictive actuator 30 can serve as a super-magnetostrictive actuator.

In the speaker apparatus of the example shown in FIG. 1, having the above-described structure, when an audio signal is supplied to the solenoid coil 32 of the magnetostrictive actuator 30, in other words, when the magnetostrictive actuator 30 is driven by the audio signal, the magnetostrictive element 31 of the magnetostrictive actuator 30 expands and contracts in the direction indicated by the arrow 1 in response to the audio signal, causing the driving rod 35 to be displaced in the same direction. Thus, longitudinal-wave vibration is applied to the point Pa on the inner end surface 13*a* of the acoustic vibration plate 10, with which the driving rod 35 is in contact.

This longitudinal wave propagates from the point Pa to a point Pr on the outer end surface 11*a* along the plate surface of the acoustic vibration plate 10. During the propagation, the longitudinal wave is mixed with a transverse wave, and the transverse wave is radiated as a sound wave in directions perpendicular to the plate surface of the acoustic vibration plate 10.

Expansion and contraction of the magnetostrictive element 31 of the magnetostrictive actuator 30 in the direction indicated by the arrow 1 causes longitudinal-wave vibration to be applied to a point Pc on the inner end surface 13*c* of the acoustic vibration plate 10, with which the base portion at the other end of the magnetostrictive actuator 30 is in contact.

This longitudinal wave is in phase with the longitudinal wave applied to the point Pa and propagates to a point on the outer end surface 11*c* along the plate surface of the acoustic vibration plate 10. During the propagation, the longitudinal wave is mixed with a transverse wave, and the transverse wave is radiated as a sound wave in directions perpendicular to the plate surface of the acoustic vibration plate 10.

Accordingly, a sound image uniformly spreads over the entire plate surface of the acoustic vibration plate 10, and the sound image is equally localized over the entire acoustic vibration plate 10.

Although the related art support structure has difficulty in supporting a very thin acoustic vibration plate, in the example according to an embodiment of the present invention, shown in FIG. 1, provision of the rectangular hole 12 in the acoustic vibration plate 10 enables the acoustic vibration plate 10 to be easily and assuredly supported.

Figure 18:
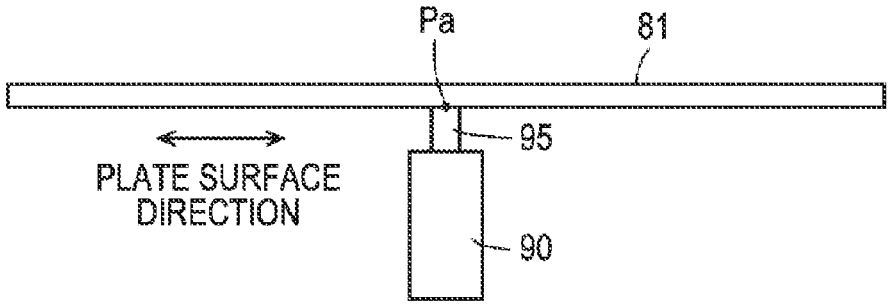
FIG. 18 (PRIOR ART)
FIG. 18 shows an example of the related art speaker apparatus.

Furthermore, even if the length of the magnetostrictive actuator 30 (the length of the magnetostrictive element 31) is increased to increase the amplitude of vibration caused by the magnetostrictive actuator 30, the size (thickness) of the entire speaker apparatus in the thickness direction of the acoustic vibration plate 10 is not changed. Thus, compared to the related art speaker apparatus in which vibration is applied to the plate-shaped acoustic vibration plate 81 in directions perpendicular to the plate surface thereof, as shown in FIG. 18, the entire speaker apparatus can be made compact.

A structure for supporting the speaker apparatus of the example shown in FIG. 1 may be, for example, a structure shown in FIG. 3.

The example of FIG. 3 shows the case of directly supporting the acoustic vibration plate 10, in which, at the end adjacent to the outer end surface 11*c* of the acoustic vibration plate 10, L-shaped angled supporting legs 41 and 42 are attached, at one end, to one surface and the other surface of the acoustic vibration plate 10 with a screw 45 and a nut 46, with damping materials 43 and 44 made of silicon rubber or the like interposed between the acoustic vibration plate 10 and the supporting legs 41 and 42.

The supporting legs 41 and 42 are placed on a desk, etc., or attached to a wall, etc., with a screw or the like.

By attaching the acoustic vibration plate 10 to the supporting legs 41 and 42 with the damping materials 43 and 44 interposed therebetween, it is possible to prevent vibration of the acoustic vibration plate 10 from propagating to a desk or a wall and the sound image from being localized at the desk or the wall.

Figure 5:
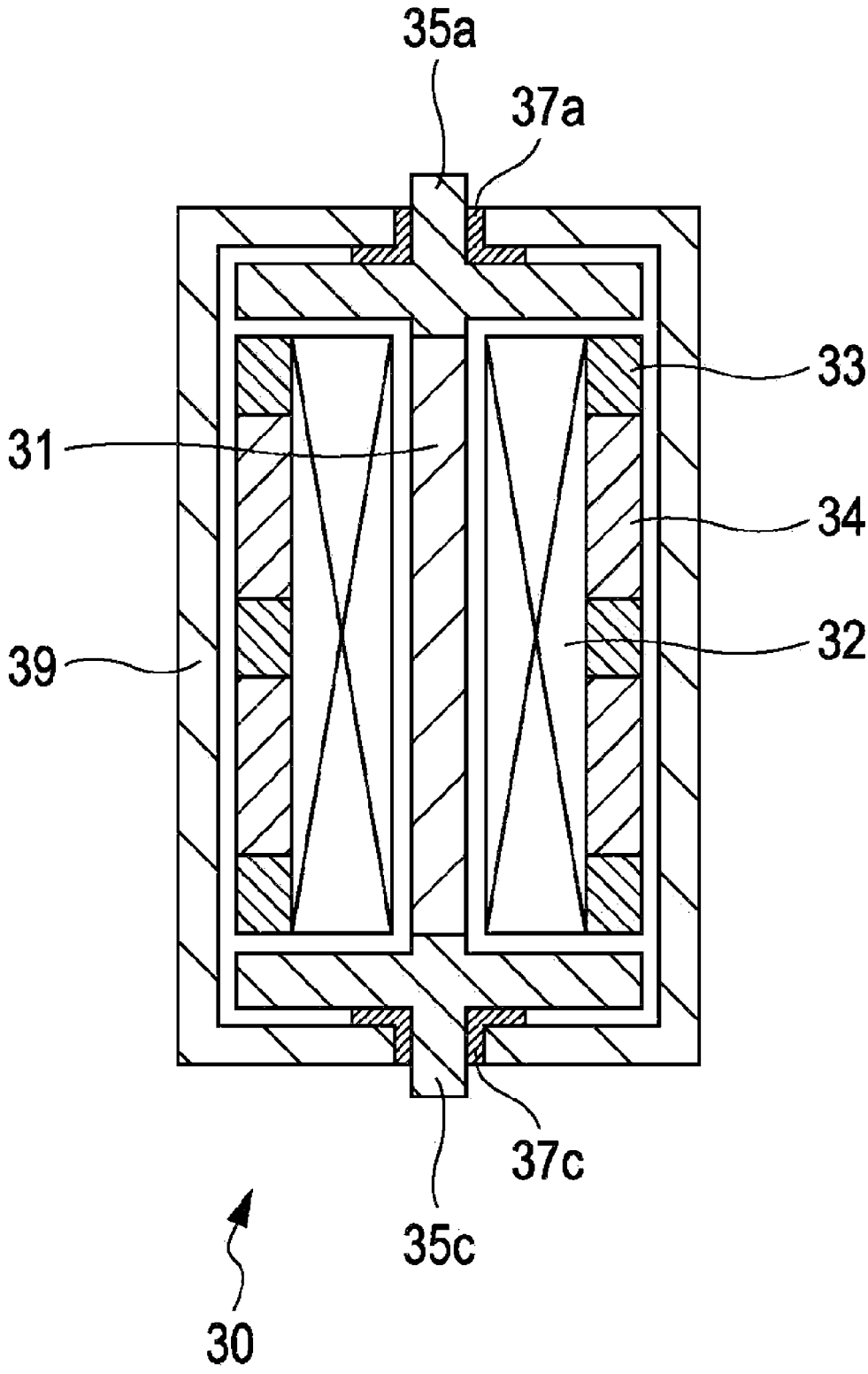
FIG. 5 shows an example of the magnetostrictive actuator.
Figure 6:
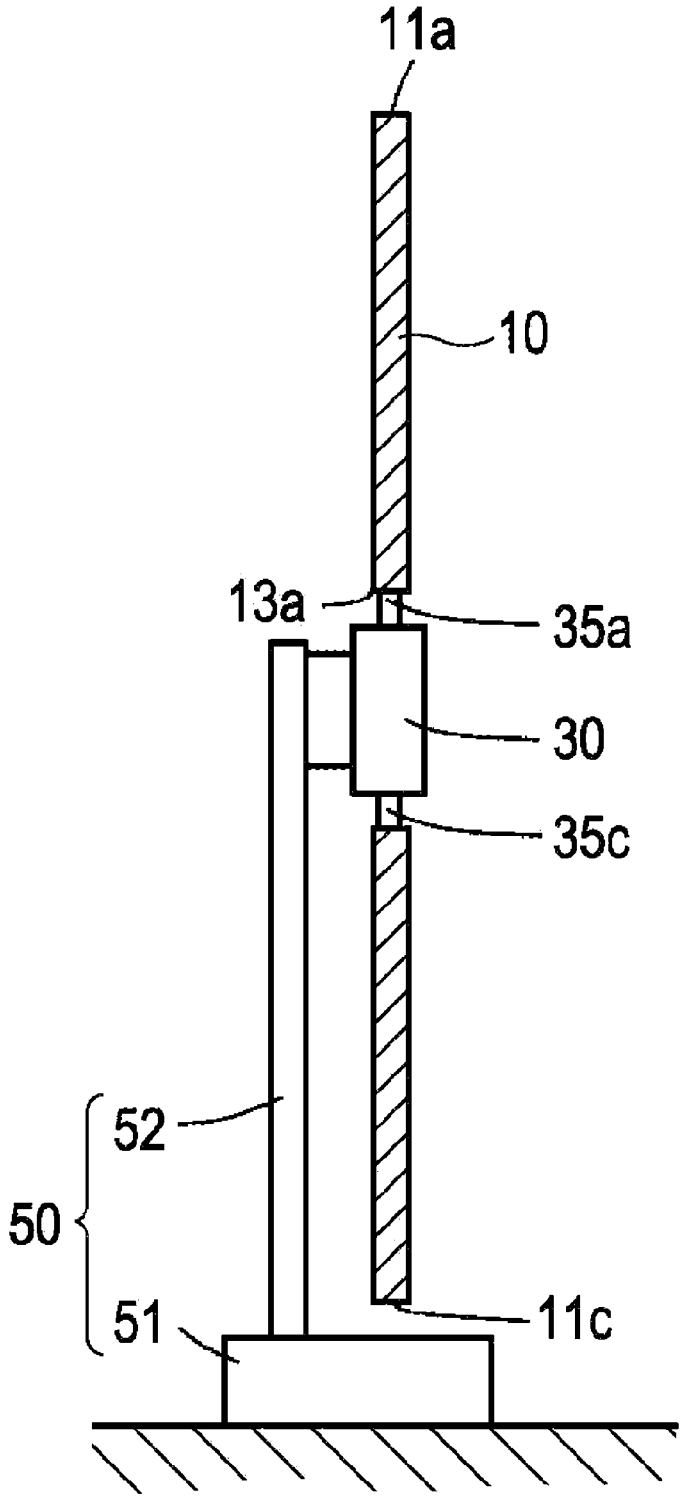
FIG. 6 shows an example of a support structure of the speaker apparatus.

1-2. Second Example of First Embodiment: FIGS. 4 to 6

Figure 4A:
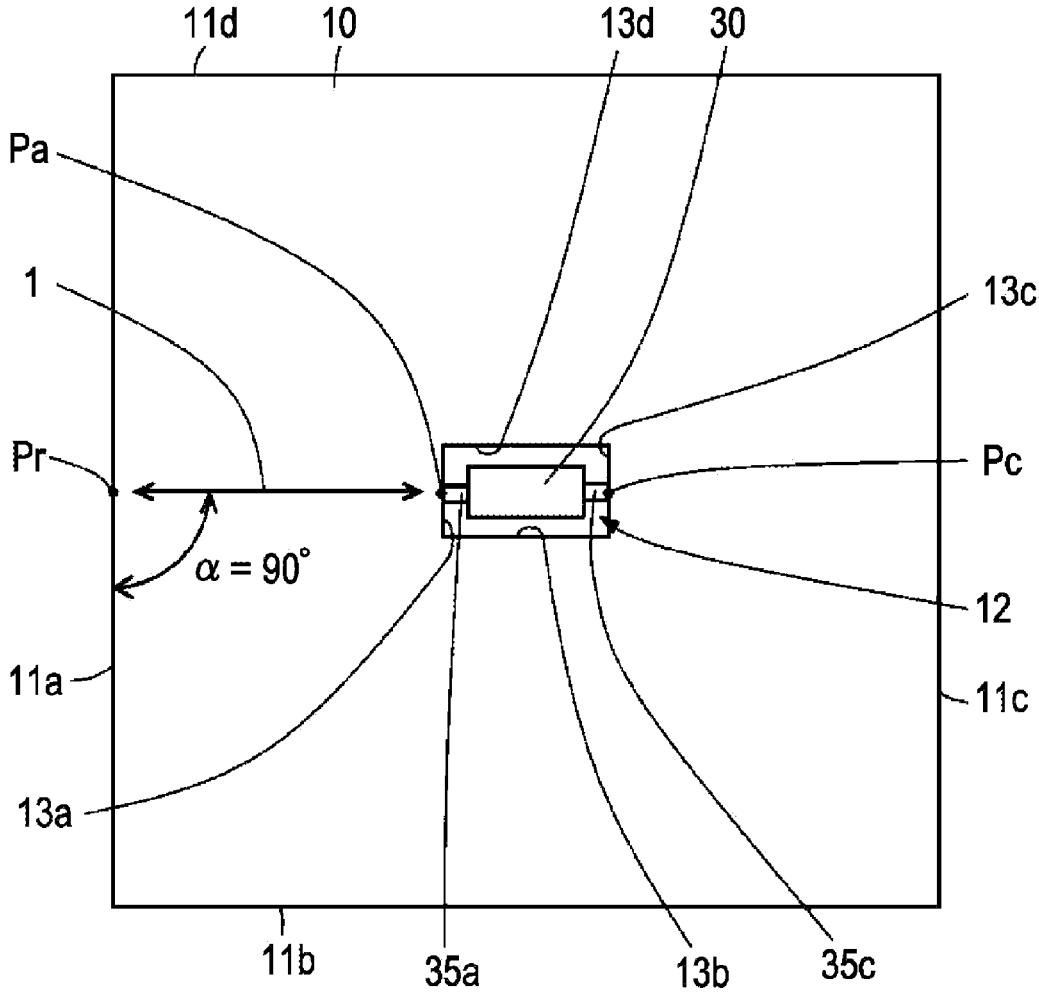
FIGS. 4A and 4B show a second example of the speaker apparatus according to the first embodiment.
Figure 4B:
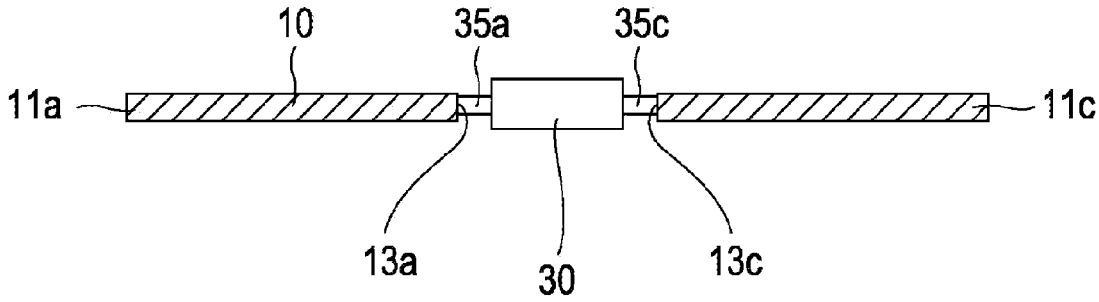

FIGS. 4A and 4B show a second example of the speaker apparatus according to the first embodiment. FIG. 4A is a plan view, and FIG. 4B is a side sectional view of the acoustic vibration plate.

In this example too, as in the example shown in FIG. 1, the square plate-shaped acoustic vibration plate 10 is provided with the rectangular hole 12, and the magnetostrictive actuator 30 is mounted in the rectangular hole 12. In this example, however, the magnetostrictive actuator 30 has driving rods 35*a* and 35*c* at one end and the other end, respectively, and the tip of the driving rod 35*a* at one end is contacted to the inner end surface 13*a* and the tip of the driving rod 35*c* at the other end is contacted to the inner end surface 13*c*.

As shown in FIG. 5, the magnetostrictive actuator 30 of this example is, for example, formed such that the actuator body, formed of the stick-shaped magnetostrictive element 31 surrounded by the solenoid coil 32 for applying a controlling electric field to the magnetostrictive element 31, the magnets 33 and yokes 34 surrounding the solenoid coil 32, the driving rod 35*a* connected to one end of the magnetostrictive element 31, and the driving rod 35*c* connected to the other end of the magnetostrictive element 31, is fitted in the outer case 39 such that the tip portions of the driving rods 35*a* and 35*c* project outward from the outer case 39, with the damping materials 37*a* and 37*c* made of silicon rubber or the like fitted to the driving rods 35*a* and 35*c*.

The outer case 39 may be formed such that separately formed two cases, that is, a case of one end and a case of the other end, or two semi-tubular cases are fitted together after the components are mounted therein, or such that a case body and a cap, formed separately, are fitted together after the components are mounted therein.

In the speaker apparatus of the example shown in FIG. 4, having the above-described structure, by driving the magnetostrictive actuator 30 by an audio signal, when the magnetostrictive element 31 of the magnetostrictive actuator 30 expands and contracts in the direction indicated by the arrow 1, longitudinal-wave vibration is applied equally to the point Pa on the inner end surface 13*a* of the acoustic vibration plate 10, with which the driving rod 35*a* is in contact, and the point Pc on the inner end surface 13*c*, with which the driving rod 35*c* is in contact. Accordingly, the sound wave radiates equally from a plate surface portion of the acoustic vibration plate 10 between the inner end surface 13*a* and the outer end surface 11*a* and a plate surface portion between the inner end surface 13*c* and the outer end surface 11*c*, whereby a sound image more uniformly spreads over the entire plate surface of the acoustic vibration plate 10.

A structure for supporting the speaker apparatus of the example shown in FIG. 4 may be, for example, a structure shown in FIG. 6.

The example of FIG. 6 shows the case of directly supporting the magnetostrictive actuator 30, in which the magnetostrictive actuator 30 is attached to a tip portion of a supporting column 52 of a supporting member 50 formed of a pedestal 51 and the supporting column 52.

The pedestal 51 is placed on a desk, etc., or attached to a wall, etc., with a screw or the like.

Note that the support structure of the speaker apparatus of the example shown in FIG. 1 may be configured to directly support the magnetostrictive actuator 30, as in the example of FIG. 6, and the support structure of the speaker apparatus of the example shown in FIG. 4 may be configured to directly support the acoustic vibration plate 10, as in the example of FIG. 3.

When compared as a support structure, the structure in which the magnetostrictive actuator 30 is directly supported, as in the example shown in FIG. 6, is more preferable than the structure in which the acoustic vibration plate 10 is directly supported, as in the example shown in FIG. 3, in that the sound quality is improved because the acoustic vibration plate 10 is not fixed.

1-3. Third Example of First Embodiment: FIG. 7

Figure 7A:
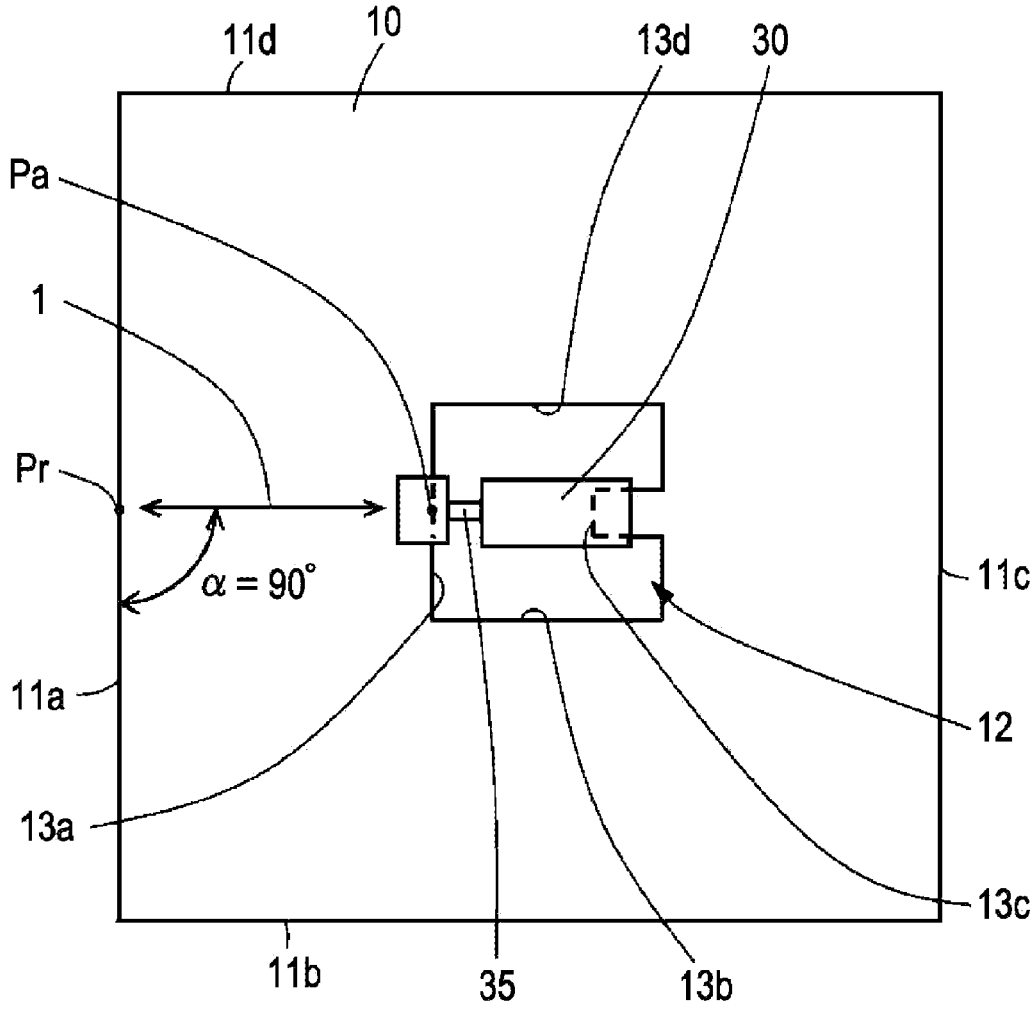
FIGS. 7A and 7B show a third example of the speaker apparatus according to the first embodiment.
Figure 7B:
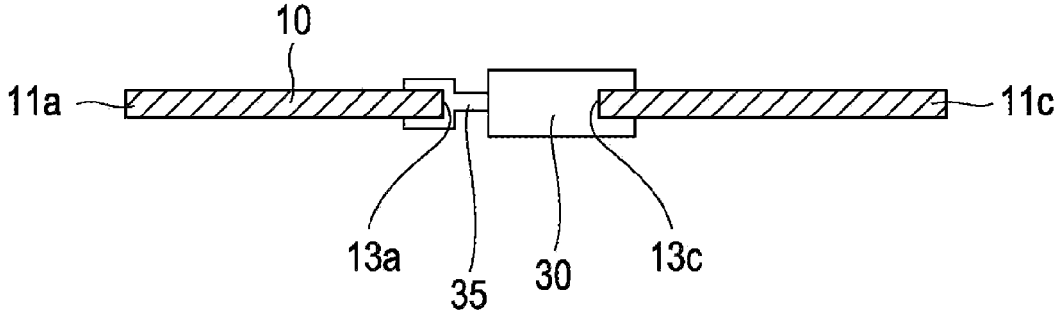

FIGS. 7A and 7B show a third example of the speaker apparatus according to the first embodiment. FIG. 7A is a plan view, and FIG. 7B is a side sectional view of the acoustic vibration plate.

This example shows the case in which the magnetostrictive actuator 30 is mounted to the acoustic vibration plate 10 such that the magnetostrictive actuator 30, at one end and the other end, pinches the acoustic vibration plate 10.

More specifically, in this example, the tip portion of the driving rod 35 at one end and the base portion at the other end of the magnetostrictive actuator 30 are shaped such that they can pinch the acoustic vibration plate 10, and the rectangular hole 12 in the acoustic vibration plate 10 is shaped such that, with respect to the direction in which the inner end surfaces 13*b* and 13*d* faces each other, the length of portions closer to the inner end surfaces 13*b* and 13*d* is larger in directions in which the inner end surfaces 13*b* and 13*d* are extended than the length of the central portion.

After the magnetostrictive actuator 30 is inserted into a portion close to the inner end surface 13*b* or a portion close to the inner end surface 13*d* of the rectangular hole 12 from one surface side of the acoustic vibration plate 10, the magnetostrictive actuator 30 is slid along the plate surface of the acoustic vibration plate 10 such that the acoustic vibration plate 10 is pinched at the tip portion of the driving rod 35 at one end and the base portion at the other end.

One of the portions at which the acoustic vibration plate 10 is pinched, the portions on the driving rod 35 at one end and the base portion at the other end of the magnetostrictive actuator 30, may be screwed to the acoustic vibration plate 10.

The magnetostrictive actuator 30 may be one having driving rods at one end and the other end, as shown in FIG. 5.

Figure 8:
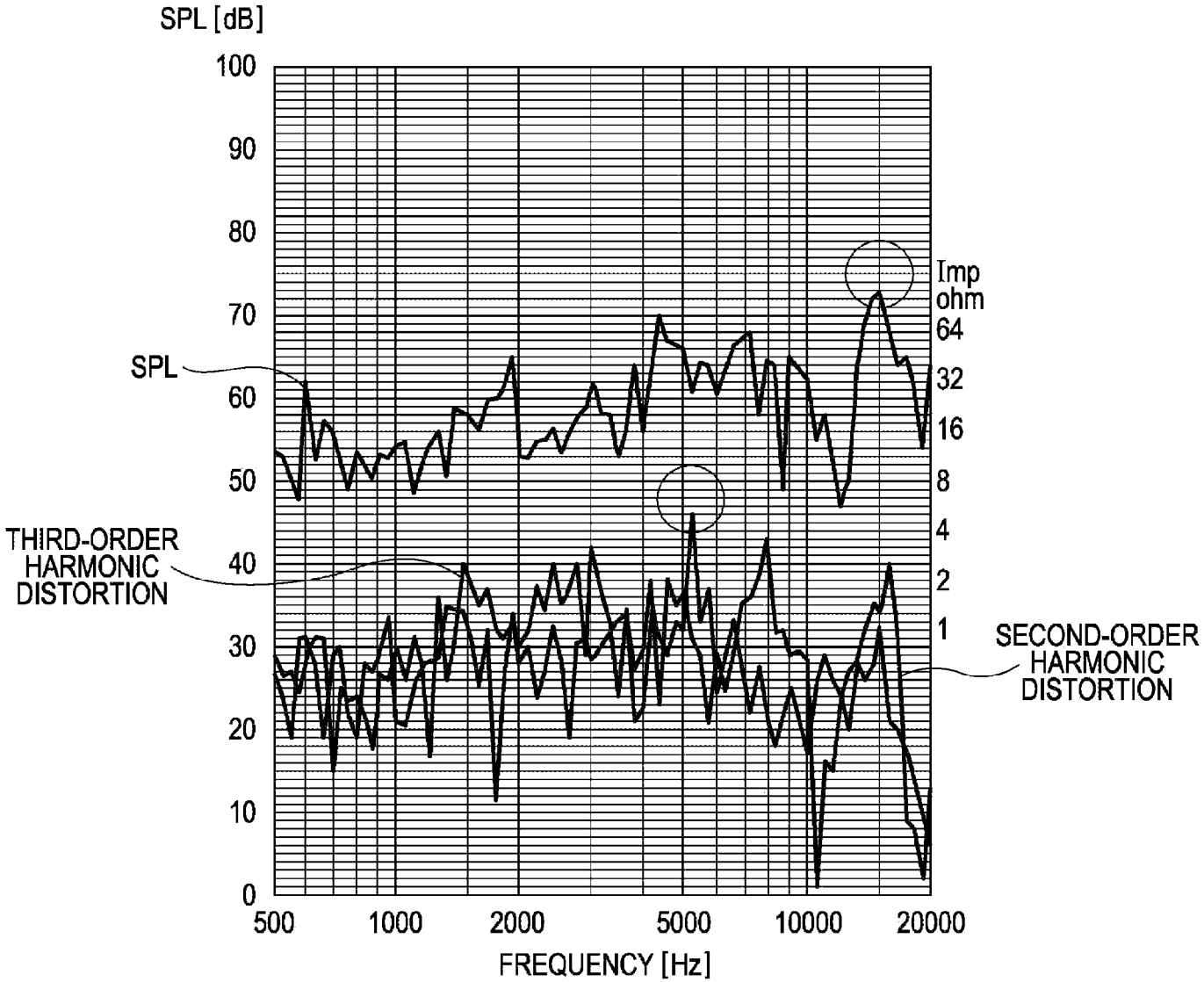
FIG. 8 is a graph showing a measurement result of sound pressure level of the speaker apparatus of the example shown in FIG. 1.

1-4. Resonance Due to Reflected Wave: FIG. 8

In the speaker apparatus of the example shown in FIGS. 1, 4 and 7, because the angle, $\alpha$, formed between the driving axis direction of the magnetostrictive actuator 30, indicated by the arrow 1, and the direction in which the outer end surface 11*a* of the acoustic vibration plate 10 is extended is a right angle, longitudinal waves propagated from the vibration-application point Pa of the acoustic vibration plate 10 to the point Pr on the outer end surface 11*a* are reflected at the point Pr in the driving axis direction of the magnetostrictive actuator 30, causing resonance between the longitudinal waves propagated to the point Pr and the longitudinal waves reflected at the point Pr. The same happens on the outer end surface 11*c* side.

FIG. 8 shows a measurement result of resonance due to reflected waves. This is a measurement result of the sound pressure level (SPL), second-order harmonic distortion, and third-order harmonic distortion obtained by mounting the magnetostrictive actuator 30 to the square plate-shaped acoustic vibration plate 10, as in the example of FIG. 1, whose edge length is 290 mm and thickness is 3 mm, as described above, and by supplying the magnetostrictive actuator 30 with an audio signal of 2 Vrms in an anechoic room.

The graph shows that resonance due to reflected waves is large at around 15000 Hz in the SPL, and at around 5000 Hz in the third-order harmonic distortion.

To reduce such resonance due to reflected waves, the speaker apparatus may be configured according to a second embodiment shown below.

2. Second Embodiment

FIGS. 9 to 12

A second embodiment shows the case in which one magnetostrictive actuator is mounted to a plate-shaped acoustic vibration plate and resonance due to reflected waves is minimized.

Figure 9:
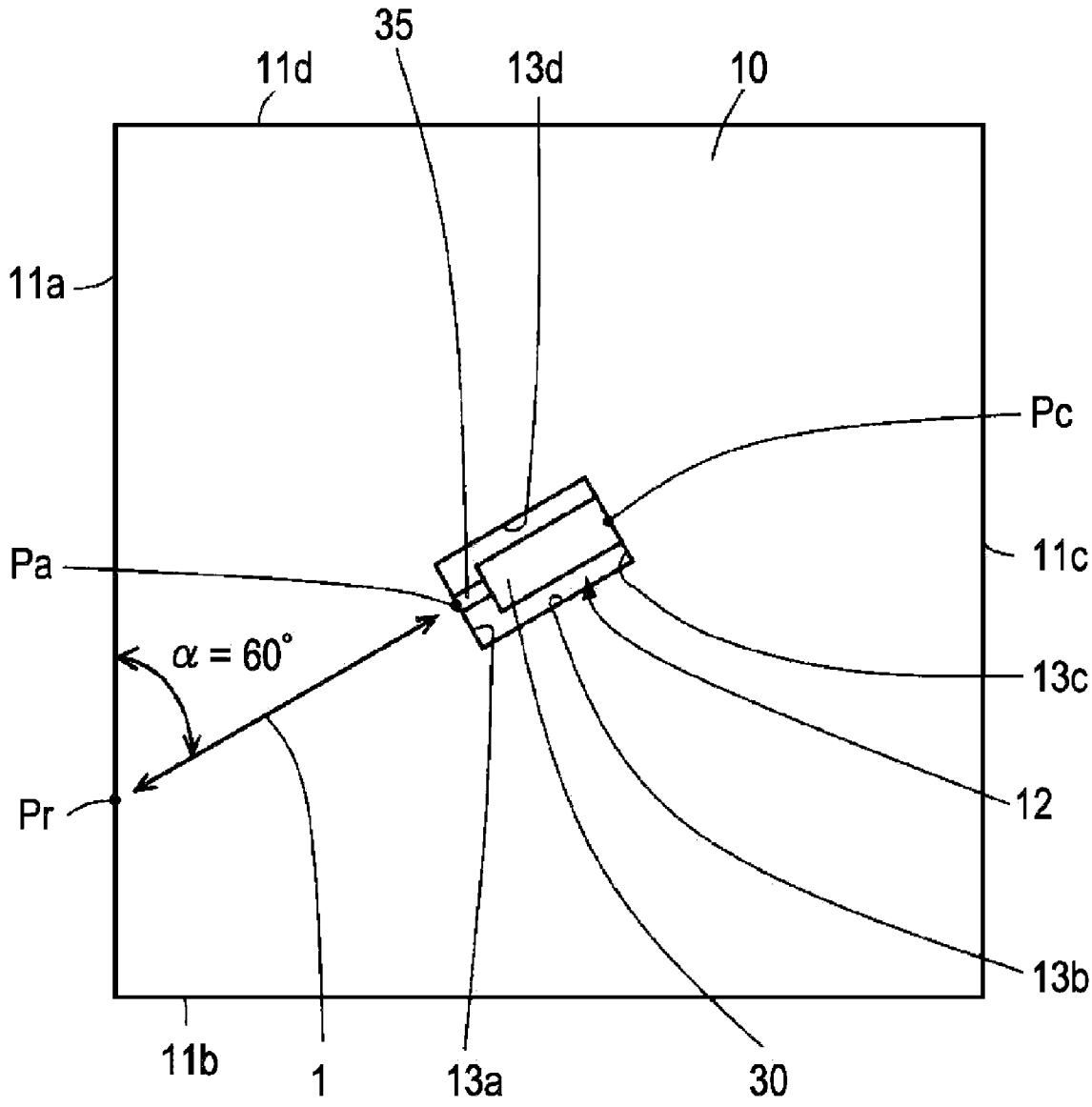
FIG. 9 shows a first example of a speaker apparatus according to a second embodiment.
Figure 10:
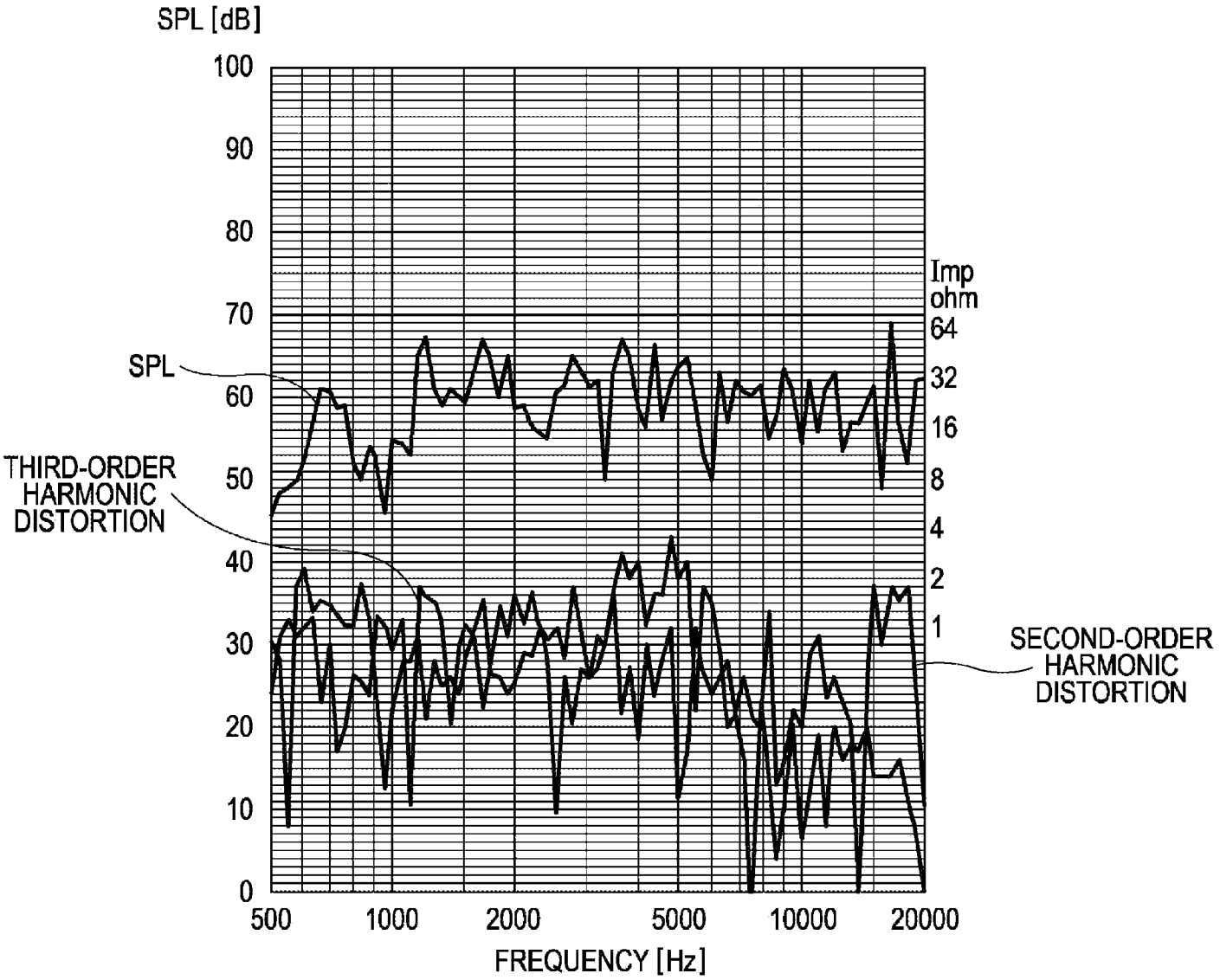
FIG. 10 is a graph showing a measurement result of sound pressure level of the speaker apparatus of the example shown in FIG. 9.

2-1. First Example of Second Embodiment: FIGS. 9 and 10

FIG. 9 shows a first example of a speaker apparatus according to the second embodiment.

In this example, although the rectangular hole 12 is provided in the square plate-shaped acoustic vibration plate 10 as in the example of FIG. 1 of the first embodiment, the inner end surfaces 13*a*, 13*b*, 13*c*, and 13*d* facing the rectangular hole 12 are not parallel to outer end surfaces 11*a*, 11*b*, 11*c*, and 11*d* of the acoustic vibration plate 10, respectively, but are inclined by 30° such that the angle, α, formed between the driving axis direction of the magnetostrictive actuator 30, indicated by the arrow 1, and the direction in which the outer end surface 11*a* of the acoustic vibration plate 10 is extended is not a right angle but 60°.

In this example, because longitudinal waves propagated from the vibration-application point Pa of the acoustic vibration plate 10 to the point Pr on the outer end surface 11*a* are reflected at the point Pr mainly in the direction of the outer end surface 11*b* of the acoustic vibration plate 10, not in the driving axis direction of the magnetostrictive actuator 30, resonance due to the reflected wave is reduced. The same happens on the outer end surface 11*c* side.

FIG. 10 shows a measurement result of this example. This is a measurement result of the SPL, second-order harmonic distortion, and third-order harmonic distortion obtained by mounting the magnetostrictive actuator 30 to the square plate-shaped acoustic vibration plate 10, as in the example of FIG. 9, whose edge length is 290 mm and thickness is 3 mm, as described above, and by supplying the magnetostrictive actuator 30 with an audio signal of 2 Vrms, in an anechoic room.

As is clear from the comparison with FIG. 8, which is the measurement result in the case of the example of FIG. 1, in the example of FIG. 9, resonance due to reflected waves is significantly small.

When the acoustic vibration plate 10 is square as in the example of FIG. 9, as the angle α is reduced such that it is at least 45°, longitudinal waves reflected in the driving axis direction of the magnetostrictive actuator 30 is reduced, resulting in a reduction in resonance due to reflected waves.

Figure 11:
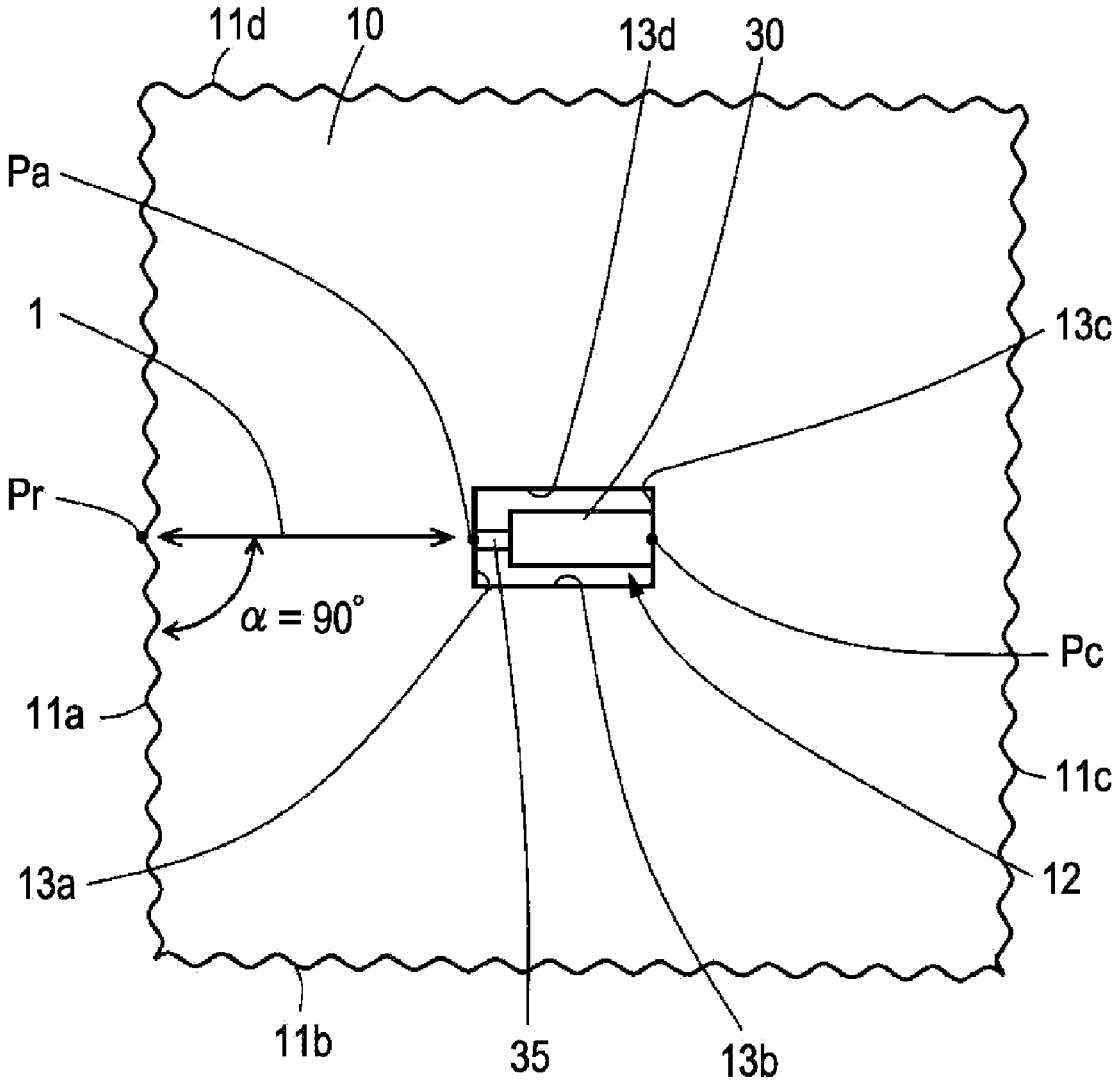
FIG. 11 shows a second example of the speaker apparatus according to the second embodiment.

2-2. Second Example of Second Embodiment: FIG. 11

FIG. 11 shows a second example of the speaker apparatus according to the second embodiment.

In this example, although the angle, α, formed between the driving axis direction of the magnetostrictive actuator 30, indicated by the arrow 1, and the direction in which the outer end surface 11*a* of the acoustic vibration plate 10 is extended is a right angle, as in the example of FIG. 1 according to the first embodiment, the outer end surfaces 11*a*, 11*b*, 11*c*, and 11*d* of the acoustic vibration plate 10 are formed as concave-convex surfaces (wavy surfaces).

In this example, longitudinal waves propagated from the vibration-application point Pa of the acoustic vibration plate 10 to the point Pr on the outer end surface 11*a* are reflected at the point Pr while the reflection directions are scattered. Thus, longitudinal waves reflected in the driving axis direction of the magnetostrictive actuator 30 are reduced, whereby resonance due to reflected waves is minimized. The same happens on the outer end surface 11*c* side.

Because longitudinal waves applied to the points Pa and Pc propagate to the outer end surfaces 11*a* and 11*c*, only the outer end surfaces 11*a* and 11*c* may be shaped as concave-convex surfaces.

Figure 12:
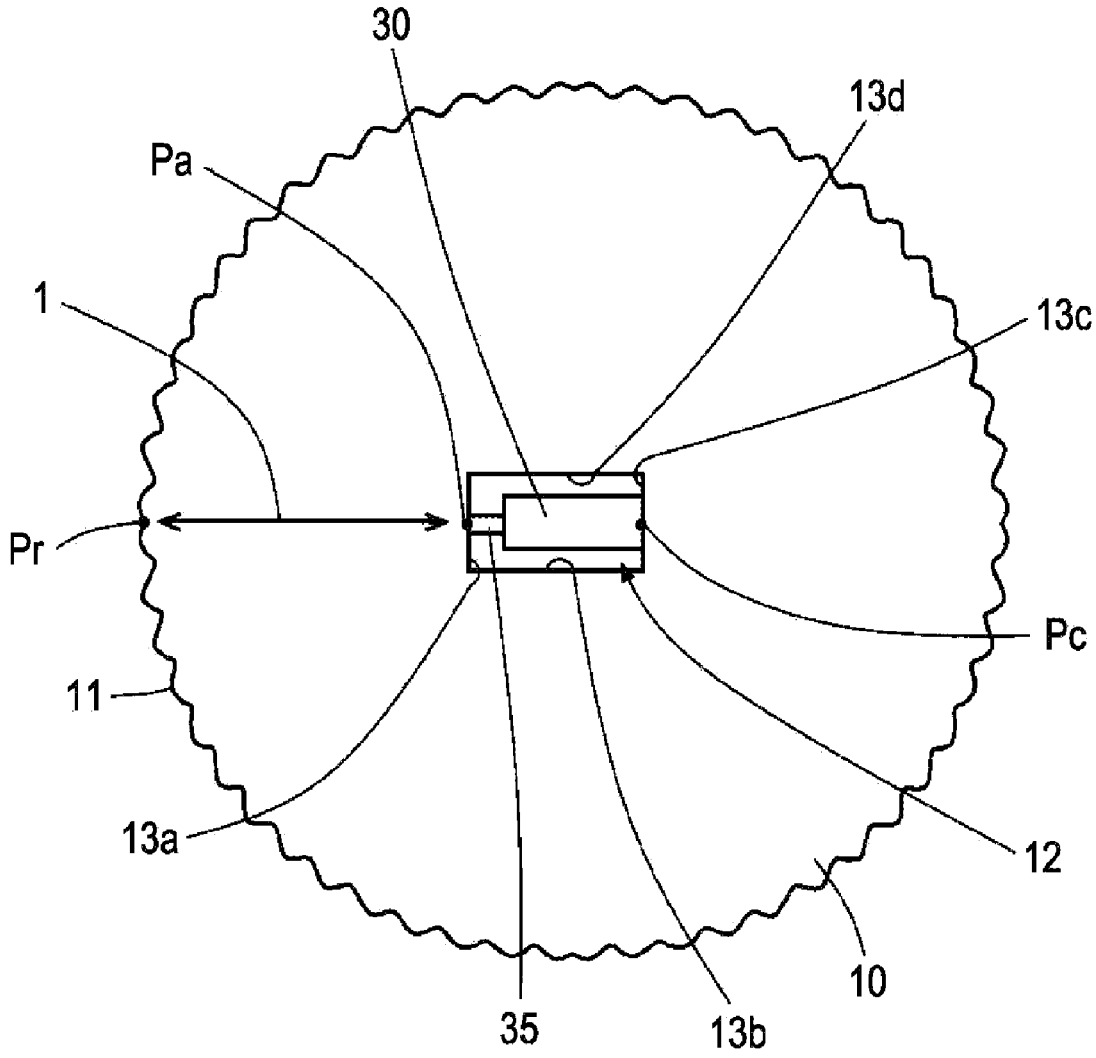
FIG. 12 shows a third example of the speaker apparatus according to the second embodiment.

2-3. Third Example of Second Embodiment: FIG. 12

Although the above-described examples show the case where the acoustic vibration plate is square, the acoustic vibration plate may be, for example, circular. FIG. 12 shows an example of such a case.

In this example, the acoustic vibration plate 10 is circular plate-shaped and is provided with the rectangular hole 12 defined by the inner end surfaces 13*a*, 13*b*, 13*c*, and 13*d* at the central portion thereof. The magnetostrictive actuator 30 is mounted in the rectangular hole 12. The outer end surface 11 of the acoustic vibration plate 10 is formed as a concave-convex surface.

In this example too, as in the example of FIG. 11, longitudinal waves propagated from the vibration-application point Pa of the acoustic vibration plate 10 to the point Pr on the outer end surface 11 are reflected at the point Pr while the reflection directions are scattered. Thus, longitudinal waves reflected in the driving axis direction of the magnetostrictive actuator 30 are reduced, whereby resonance due to reflected waves is minimized.

3. Third Embodiment

FIG. 13

A third embodiment shows the case in which the acoustic vibration plate is curved.

Figure 13A:
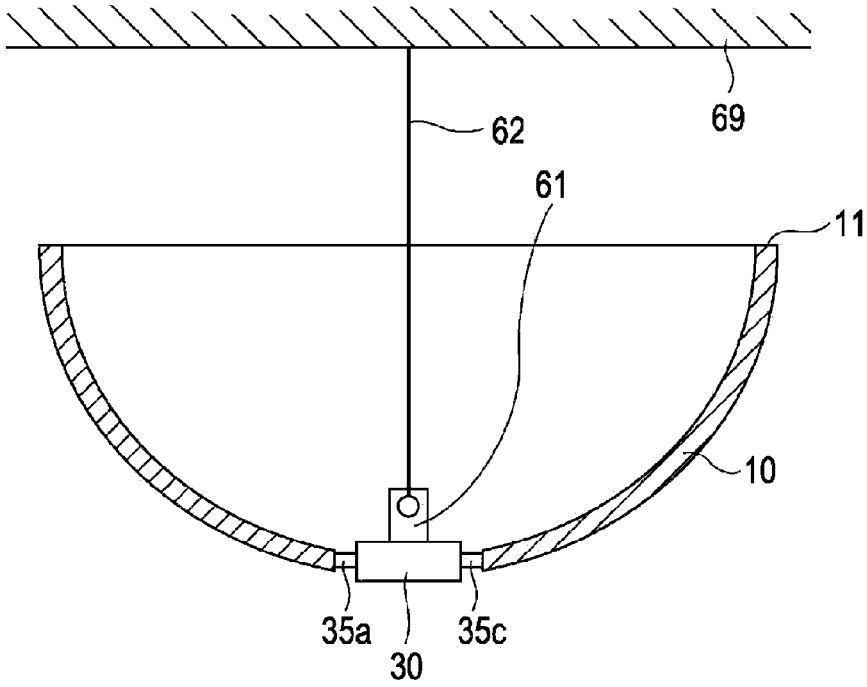
FIGS. 13A and 13B show an example of a speaker apparatus according to a third embodiment.
Figure 13B:
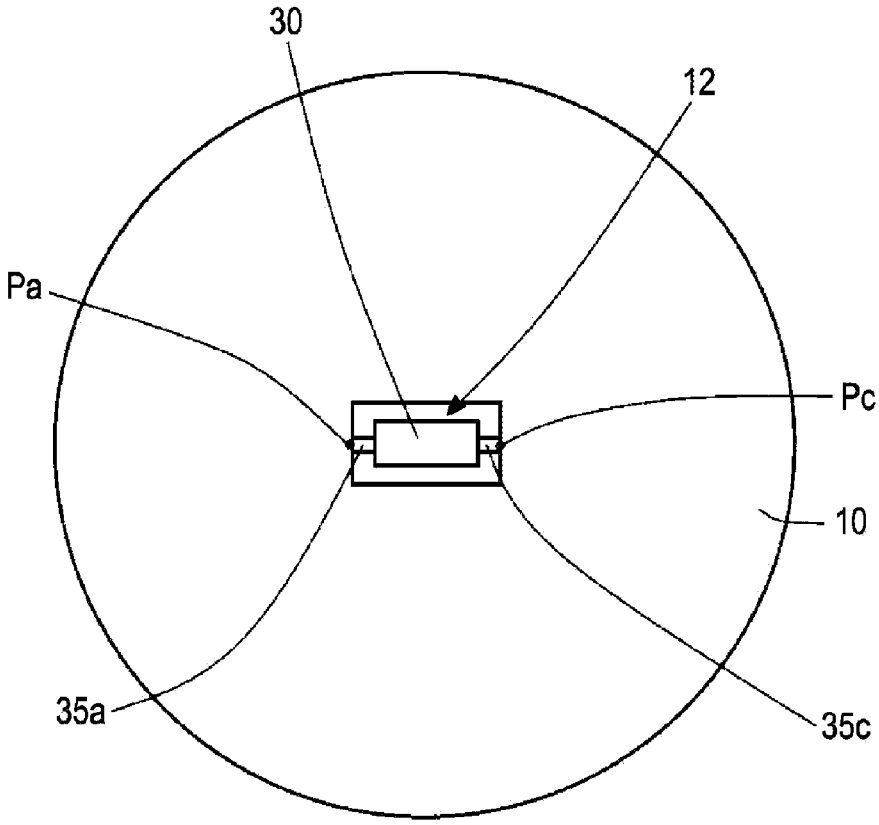

FIGS. 13A and 13B show an example of a speaker apparatus according to the third embodiment. FIG. 13A is a side sectional view of the speaker apparatus hung from the ceiling, and FIG. 13B is a plan view.

In this example, the acoustic vibration plate 10 is curved in a hemispherical shape and has the rectangular hole 12 at the central portion thereof. The magnetostrictive actuator 30, to which a hanging member 61 is attached, is mounted to the rectangular hole 12. The magnetostrictive actuator 30 and the acoustic vibration plate 10 are hung from a ceiling 69 through a hanging wire 62.

In this example, the magnetostrictive actuator 30 has the driving rods 35*a* and 35*c* at one end and the other end, as shown in FIG. 5.

Because the speaker apparatus according to an embodiment of the present invention can be made lighter in weight and the acoustic vibration plate thereof can be supported by an actuator, the speaker apparatus can be constructed as a hanging type, as in this example, to be hung from the ceiling.

To minimize the resonance due to the longitudinal waves reflected at the outer end surface (terminal end surface) 11 of the acoustic vibration plate 10, the outer end surface 11 may be shaped as a concave-convex surface.

4. Fourth Embodiment

Figure 14:
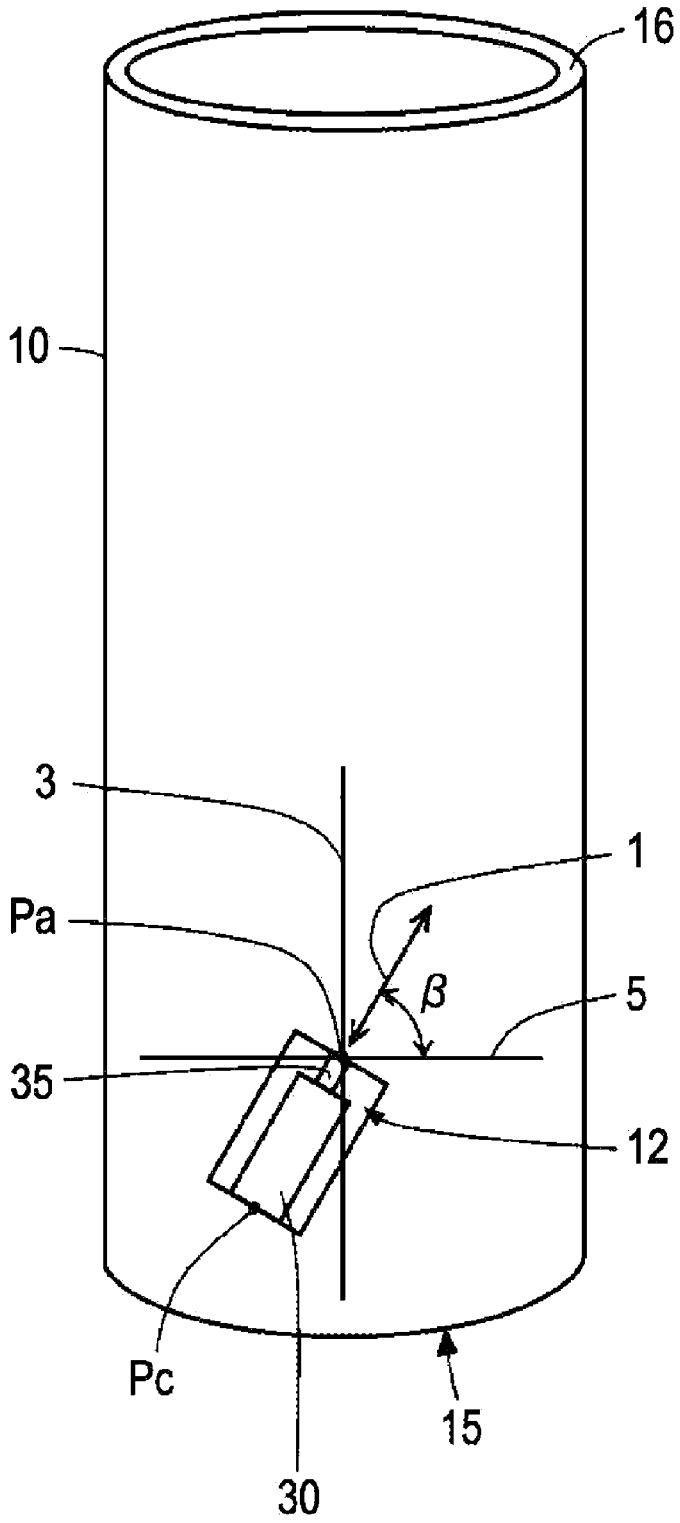
FIG. 14 shows a first example of a speaker apparatus according to a fourth embodiment.
Figure 15:
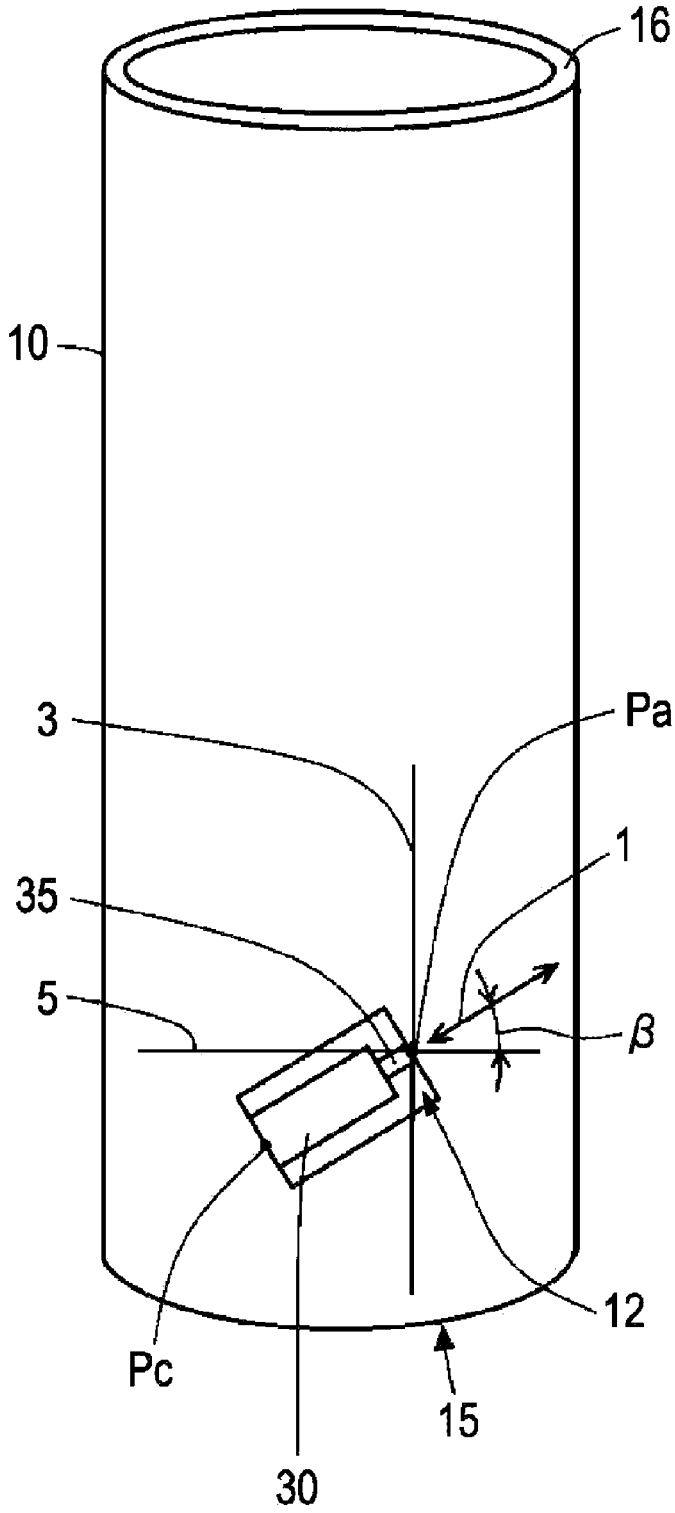
FIG. 15 shows a second example of the speaker apparatus according to the fourth embodiment.

FIGS. 14 and 15

A fourth embodiment shows the case in which the acoustic vibration plate is tubular.

4-1. First Example of Fourth Embodiment: FIG. 14

FIG. 14 shows a first example of a speaker apparatus according to a fourth embodiment.

In this example, the acoustic vibration plate 10 is cylindrical with both ends open and has the rectangular hole 12 in a portion close to one end surface 15. The magnetostrictive actuator 30 is mounted in the rectangular hole 12 such that the driving axis direction, indicated by the arrow 1, is inclined with respect to the central axis direction of the acoustic vibration plate 10, indicated by a straight line 3, and the direction perpendicular to the central axis direction, indicated by a straight line 5, and such that the tip of the driving rod 35 is oriented in the other end surface 16 of the acoustic vibration plate 10.

This example shows the case in which an angle, β, formed between the driving axis direction of the magnetostrictive actuator 30, indicated by the arrow 1, and the direction indicated by the straight line 5, the angle β corresponding to the angle α of the example of FIG. 9 according to the second embodiment, is relatively large such that it is less than 90°.

When the acoustic vibration plate 10 is supported vertically, for example, the one end surface 15 is positioned on the lower side and the other end surface 16 is positioned on the upper side, and the direction indicated by the straight line 5 agrees with the horizontal direction. When the acoustic vibration plate 10 is supported horizontally, the direction indicated by the straight line 5 agrees with the top-bottom direction.

In this example, as in the respective examples such as the example of FIG. 1, a sound image uniformly spreads over the entire plate surface of the acoustic vibration plate 10, and the sound image is equally localized over the entire acoustic vibration plate 10.

In addition, because the angle β is made less than 90°, resonance due to the longitudinal waves reflected at the other end surface (the outer end surface on the other end) 16 and the one end surface (the outer end surface on one end) 15 of the acoustic vibration plate 10 is reduced, as in the example of FIG. 9 according to the second embodiment.

Figure 19:
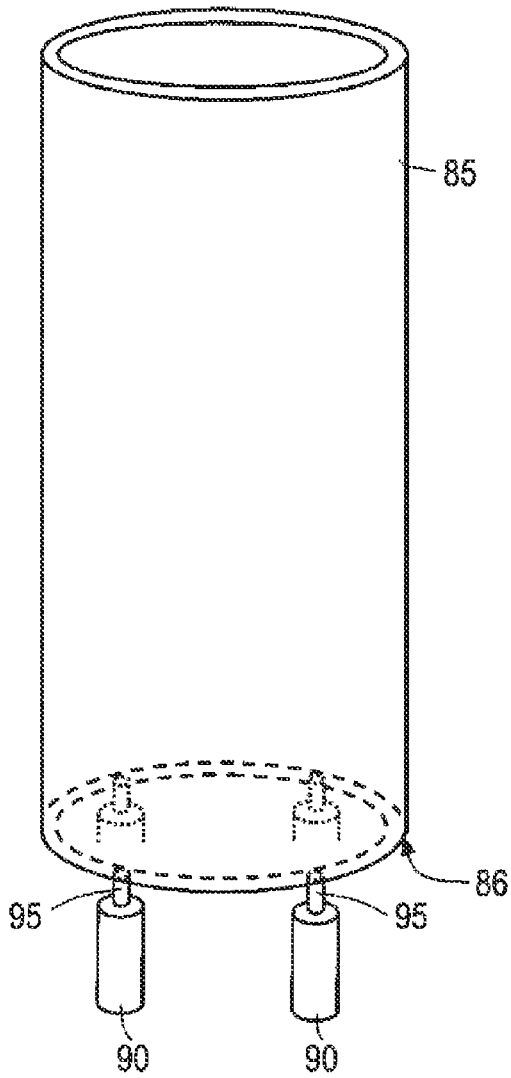
FIG. 19 (PRIOR ART)
FIG. 19 shows another example the related art speaker apparatus.

Furthermore, because the magnetostrictive actuator 30 is mounted in the rectangular hole 12 in the acoustic vibration plate 10 whereby it is not necessary to provide a supporting member having a hole for receiving a magnetostrictive actuator, as in the case of the related art speaker apparatus shown in FIG. 19, the speaker apparatus can be made compact, about the same size as the acoustic vibration plate 10.

A structure for supporting the speaker apparatus of this example may be the same as that shown in FIG. 3.

More specifically, for example, L-shaped angled supporting legs are attached, at one end, to the outer surface of the acoustic vibration plate 10 adjacent to the one end surface 15, at a plurality of equally spaced portions in the circumferential direction of the acoustic vibration plate 10 with screws and nuts, with damping materials made of silicon rubber or the like interposed between the acoustic vibration plate 10 and the supporting legs.

One or both of the one end and the other end of the acoustic vibration plate 10 may have a bottom.

4-2. Second Example of Fourth Embodiment: FIG. 15

FIG. 15 shows a second example of the speaker apparatus according to the fourth embodiment.

In this example too, as in the example of FIG. 14, the acoustic vibration plate 10 is cylindrical and has the rectangular hole 12 in a portion close to the one end surface 15, into which the magnetostrictive actuator 30 is mounted. However, in this example, the angle β is relatively small such that it is larger than 0°.

In this example, because the angle β is small, longitudinal-wave vibration applied to the point Pa of the acoustic vibration plate 10, with which the driving rod 35 of the magnetostrictive actuator 30 is in contact, propagates spirally along the circumference of the plate surface of the acoustic vibration plate 10 to the other end surface 16 of the acoustic vibration plate 10. Accordingly, compared to the example of FIG. 14, a sound image spreads over the entire plate surface of the acoustic vibration plate 10 more uniformly, and the sound image is more equally localized over the entire acoustic vibration plate 10.

Furthermore, because the angle β is small, resonance due to the longitudinal waves reflected at the other end surface 16 and the one end surface 15 of the acoustic vibration plate 10 is further reduced.

5. Fifth Embodiment

Figure 16:
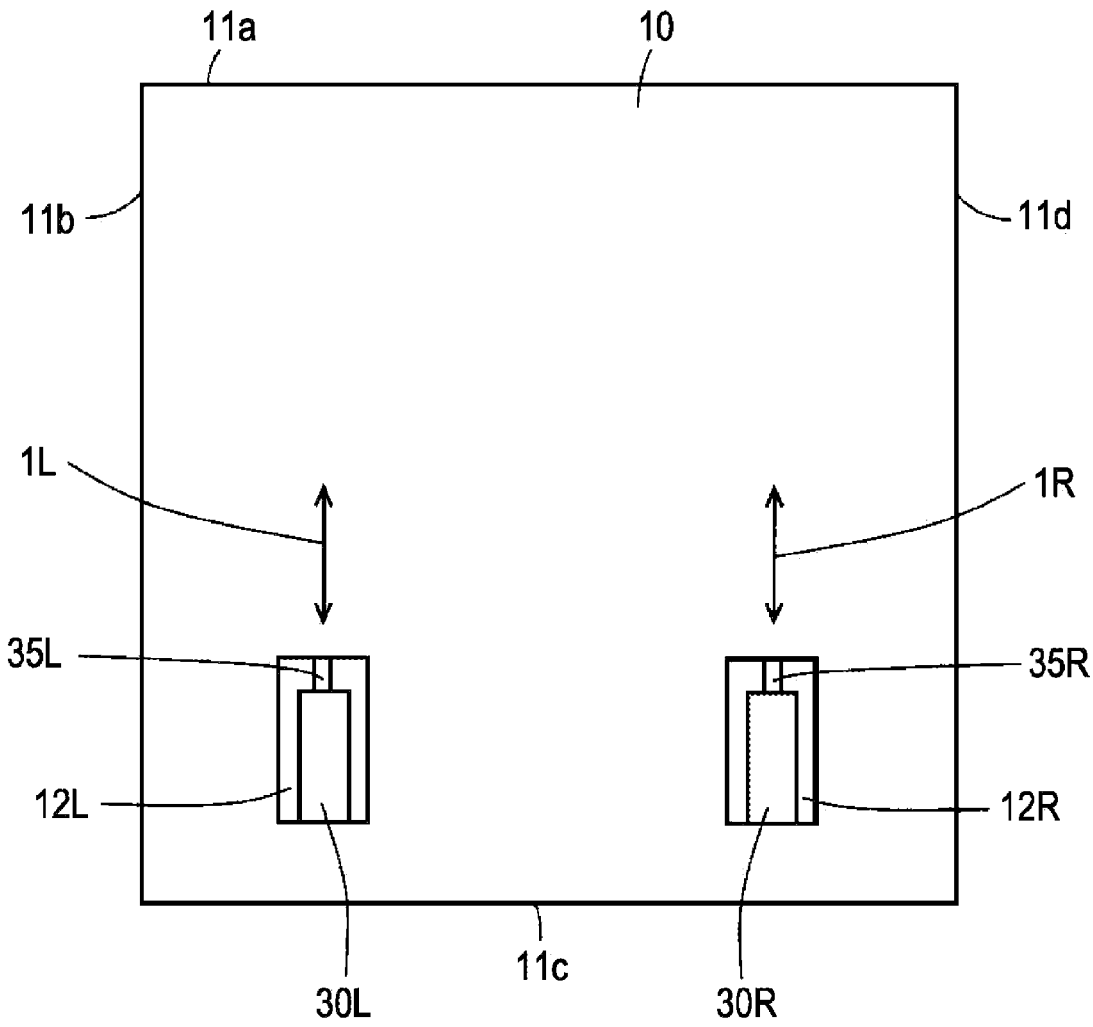
FIG. 16 shows a first example of a speaker apparatus according to a fifth embodiment.
Figure 17:
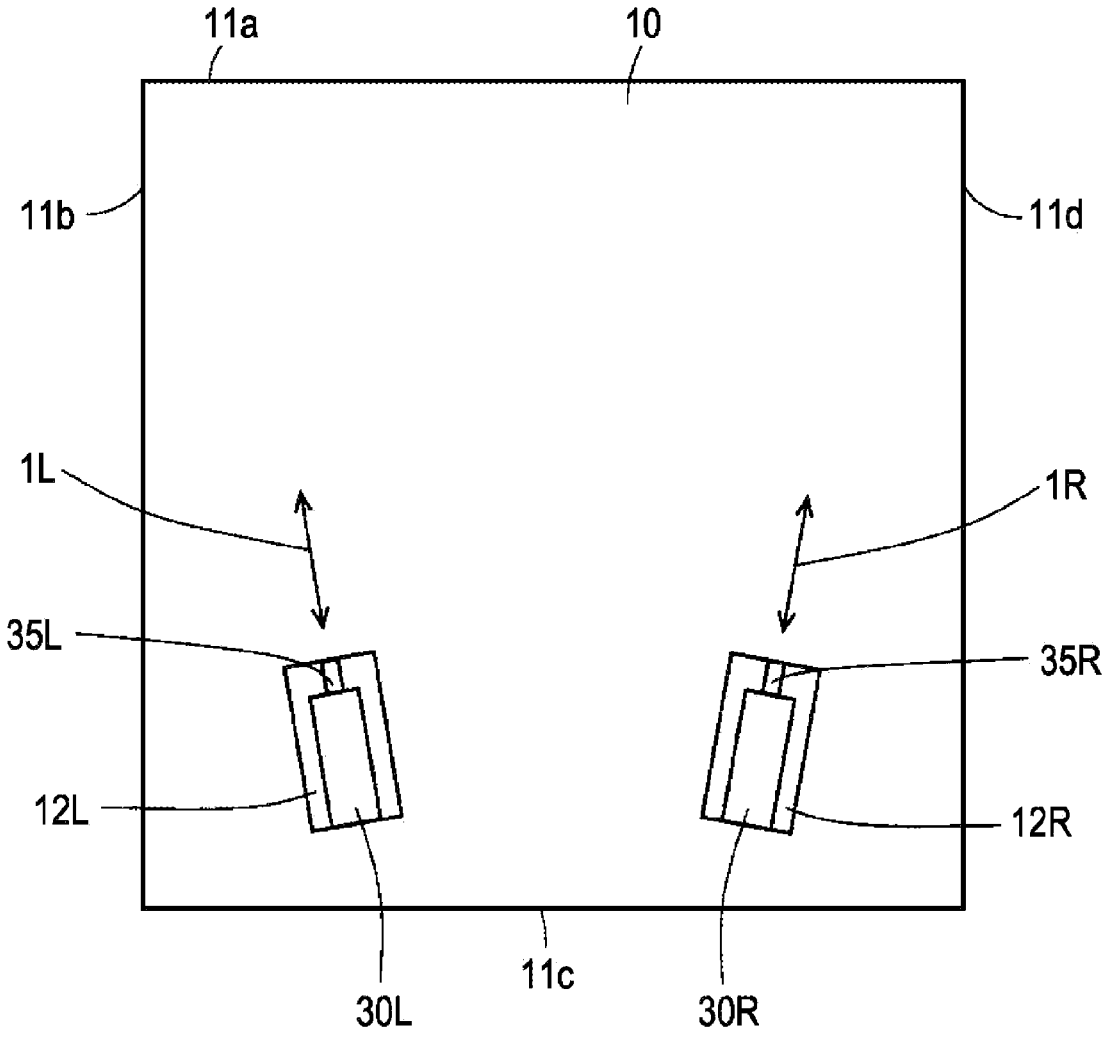
FIG. 17 shows a second example of the speaker apparatus according to the fifth embodiment.

FIGS. 16 and 17

A fifth embodiment shows the case in which two magnetostrictive actuators are mounted to one acoustic vibration plate to play back stereo sound.

5-1. First Example of Fifth Embodiment: FIG. 16

FIG. 16 shows a first example of a speaker apparatus according to the fifth embodiment.

In this example, the acoustic vibration plate 10 is square or rectangular and is provided with two rectangular holes 12L and 12R arranged parallel to each other at positions close to an end surface of the acoustic vibration plate 10, namely, the outer end surface 11*c*.

Magnetostrictive actuators 30L and 30R having driving rods 35L and 35R, respectively, are mounted in the rectangular holes 12L and 12R such that the driving axis directions, indicated by the arrows 1L and 1R, are parallel to each other and such that the tips of the driving rods 35L and 35R are oriented in the surface opposite to the outer end surface 11*c*, namely, the outer end surface 11*a*.

The magnetostrictive actuator 30L is driven by left-channel audio signals among stereo audio signals, and the magnetostrictive actuator 30R is driven by right-channel audio signals among the stereo audio signals.

Thus, the longitudinal-wave vibrations caused by the left channel and right-channel audio signals propagate along the same plate surface of the acoustic vibration plate 10, and the stereo sound is played back.

To minimize the resonance due to the longitudinal waves reflected at the outer end surfaces 11*a* and 11*c* of the acoustic vibration plate 10, the outer end surfaces 11*a* and 11*c* may be shaped as concave-convex surfaces.

5-2. Second Example of Fifth Embodiment: FIG. 17

FIG. 17 shows a second example of the speaker apparatus according to the fifth embodiment.

In this example, the acoustic vibration plate 10 is square or rectangular and is provided with the two rectangular holes 12L and 12R that are inclined with respect to each other and arranged at positions close to an end surface of the acoustic vibration plate 10, namely, the outer end surface 11*c*. The magnetostrictive actuators 30L and 30R having driving rods 35L and 35R, respectively, are mounted in the rectangular holes 12L and 12R such that the driving axis directions, indicated by the arrows 1L and 1R, are inclined with respect to each other and such that the tips of the driving rods 35L and 35R are oriented in positions close to the corners of the acoustic vibration plate 10 on the surface opposite to the outer end surface 11*c*, namely, the outer end surface 11*a*.

The magnetostrictive actuator 30L is driven by left-channel audio signals among stereo audio signals, and the magnetostrictive actuator 30R is driven by right-channel audio signals among the stereo audio signals.

Thus, the longitudinal-wave vibrations caused by the left channel and right-channel audio signals propagate along the same plate surface of the acoustic vibration plate 10, and the stereo sound is played back.

Further, in this example, because the width between the longitudinal waves applied to the acoustic vibration plate 10 by the magnetostrictive actuator 30L according to a left-channel audio signal and by the magnetostrictive actuator 30R according to a right-channel audio signal gradually increases as they approach the outer end surface 11*a*, the stereo impression is enhanced compared to the example of the FIG. 16.

In addition, in this example, because the angles between the direction in which the outer end surface 11*a* of the acoustic vibration plate 10 is extended and the driving axis directions of the magnetostrictive actuators 30L and 30R are not right angles, resonance due to reflected waves is minimized, as in the example of FIG. 9 of the second embodiment.

6. Other Examples and Embodiments 6-1. Acoustic Vibration Plate

Examples of the shape of the acoustic vibration plate include, when it is plate-shaped, in addition to rectangular and circular, polygonal such as triangular or pentagonal and curved shape such as elliptical.

Examples of the entire shape of the acoustic vibration plate include a box shape such as a cube or a rectangular parallelepiped, a pyramid shape such as a triangular pyramid or a quadrangular pyramid, a circular cone, and a spheroid. In the case of a box shape or a pyramid shape, although each surface is plate-shaped (planar), the entirety is not plate-shaped. A circular cone and a spheroid are exemplary curved acoustic vibration plates similar to the hemispherical shape of the example of FIG. 13.

Examples of the shape of acoustic vibration plate include, when it is tubular, in addition to cylindrical as in the examples of FIGS. 14 and 15, a semi-tubular shape, an elliptic cylindrical shape, and a pentagonal tubular shape whose cross section perpendicular to the central axis direction is polygonal such as triangle or rectangle. A semi-tubular shape and an elliptic cylindrical shape are also exemplary curved acoustic vibration plates similar to the cylindrical shape. In the case of a pentagonal tubular shape, although each surface is plate-shaped (planar), the entirety is not plate-shaped.

The shape of the hole provided in the acoustic vibration plate is not limited to rectangular, and it may be circular or elliptical as long as the actuator, such as the magnetostrictive actuator, can be mounted therein.

The material of the acoustic vibration plate is not limited to acrylic, and it may be glass or the like.

6-2. Actuator

Although the previous examples show the cases in which a magnetostrictive actuator (including a super-magnetostrictive actuator) is used as the actuator, a piezoelectric actuator (an actuator using a piezoelectric element) may be used as the actuator.

6-3. Embodiment as Speaker System

Although the examples of FIGS. 16 and 17, shown as the fifth embodiment, are the case in which stereo sound is played back by a speaker apparatus having two magnetostrictive actuators, 30L and 30R, mounted to one acoustic vibration plate 10, stereo sound may be played back by arranging two of the speaker apparatus shown in FIG. 1 or FIG. 9 for the left and right channels such that the driving axis directions of the actuators of the speaker apparatuses for the left and right channels are parallel to each other or intersect each other.

It should be understood by those skilled in the art that various modifications, combinations, sub-combinations and alterations may occur depending on design requirements and other factors insofar as they are within the scope of the appended claims or the equivalents thereof.

What is claimed is:

1. A speaker apparatus comprising:

an acoustic vibration plate; and an actuator mounted to the acoustic vibration plate such that a first end of the actuator and a second end of the actuator exist in a plate surface of the acoustic vibration plate, the second end being opposite the first end in a driving axis direction of the actuator.

2. The speaker apparatus according to claim 1, wherein the acoustic vibration plate has a hole in which the actuator is mounted.

3. The speaker apparatus according to claim 1, wherein the acoustic vibration plate is plate-shaped.

4. The speaker apparatus according to claim 3, wherein the driving axis direction of the actuator and a second direction do not form a right angle, the second direction being a direction in which vibration propagates in the acoustic vibration plate.

5. The speaker apparatus according to claim 3, wherein an outer end surface of the acoustic vibration plate is shaped as a concave-convex surface.

6. The speaker apparatus according to claim 1, wherein the acoustic vibration plate is curved.

7. The speaker apparatus according to claim 1, wherein the acoustic vibration plate is tubular.

8. The speaker apparatus according to claim 7, wherein the driving axis direction of the actuator is inclined with respect to a central axis direction of the acoustic vibration plate and a direction perpendicular to the central axis direction.

9. The speaker apparatus according to claim 1, wherein the actuator is a magnetostrictive actuator.

10. The speaker apparatus according to claim 1, wherein the actuator is a piezoelectric actuator.

11. A speaker apparatus comprising:

an acoustic vibration plate; and first and second actuators mounted in the acoustic vibration plate such that each actuator has a first end and a second end, existing in a plate surface of the acoustic vibration plate, the second end being opposite the first end in a driving axis direction of the actuator.

12. The speaker apparatus according to claim 11, wherein the driving axis direction of the first actuator is not parallel to the driving axis direction of the second actuator.

13. A method for driving a speaker, the speaker having an acoustic vibration plate and first and second actuators mounted in the acoustic vibration plate such that each actuator has a first end and a second end existing in a plate surface of the acoustic vibration plate, the second end being opposite the first end in a driving axis direction of the actuator, the method comprising:

driving the first actuator with left-channel audio signals among stereo audio signals; and driving the second actuator with right-channel audio signals among the stereo audio signals.

14. The method according to claim 13, wherein, in the speaker, the driving axis direction of the first actuator is not parallel to the driving axis direction of the second actuator.

15. A speaker apparatus comprising:

a non-cylindrical acoustic vibration plate; and an actuator mounted to the non-cylindrical acoustic vibration plate and configured to apply a vibrational force in a longitudinal-wave direction to the non-cylindrical acoustic vibration plate.

16. The speaker apparatus according to claim 15, wherein a first end of the actuator and a second end of the actuator exist in a plane parallel to a plate surface of the acoustic vibration plate.

17. The speaker apparatus according to claim 15, wherein a first end of the actuator and a second end of the actuator exist in a plane that is tangent to a plate surface of the acoustic vibration plate.

18. A method for driving a speaker, the speaker having a non-cylindrical acoustic vibration plate and an actuator mounted to the non-cylindrical acoustic vibration plate, the method comprising:

applying a force in a longitudinal-wave direction to the non-cylindrical acoustic vibration plate.

19. The method according to claim 18, wherein a first end of the actuator and a second end of the actuator exist in a plane parallel to a plate surface of the acoustic vibration plate.

20. The method according to claim 18, wherein a first end of the actuator and a second end of the actuator exist in a plane that is tangent to a plate surface of the acoustic vibration plate.

* * * * *